US006932428B2

(12) United States Patent
Murphy

(10) Patent No.: US 6,932,428 B2
(45) Date of Patent: Aug. 23, 2005

(54) CONNECTOR FOR ADJACENT SEATING UNITS

(75) Inventor: Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 0 days.

(21) Appl. No.: 10/751,272

(22) Filed: Jan. 2, 2004

(65) Prior Publication Data

US 2005/0146179 A1 Jul. 7, 2005

(51) Int. Cl.[7] ..... A47C 15/00
(52) U.S. Cl. ..... 297/248; 403/322.3; 403/330
(58) Field of Search ..... 297/248; 108/64, 108/185; 312/111; 403/321, 322.1, 323, 322.3, 403/326, 330; 292/63, 64, 67, 71, 109, 110, 292/114, 341.18, 341.19, 290

(56) References Cited

U.S. PATENT DOCUMENTS 2,904,101 A * 9/1959 Stephan ..... 297/248
4,386,804 A * 6/1983 Ware et al. ..... 297/248
4,690,440 A * 9/1987 Rogers ..... 292/54
5,129,703 A * 7/1992 Ballendat et al. ..... 297/248
5,352,017 A * 10/1994 Berning ..... 297/248
5,542,159 A * 8/1996 Schultz et al. ..... 297/248
5,544,938 A * 8/1996 Saul et al. ..... 297/248
5,560,678 A * 10/1996 Eppelt ..... 297/248
5,782,507 A * 7/1998 Hardee ..... 292/267
5,931,529 A * 8/1999 LaPointe et al. ..... 297/248

* cited by examiner

*Primary Examiner*—Peter R. Brown
(74) *Attorney, Agent, or Firm*—Myers Bigel Sibley & Sajovec

(57) ABSTRACT

A furniture assembly includes: a first seating unit with a stationary support; a second seating unit with a stationary support; and a connector that is configured to interconnect the first and second seating units such that respective lateral portions thereof are adjacent. The connector includes: a first component attached to the stationary support of the first seating unit; a second component attached to the stationary support of the second seating unit; and interconnecting structure attached to the first and second components that (a) prevents relative horizontal movement of the first and second seating units when the first and second seating units are in an interconnected condition, and (b) permits relative vertical movement of the first and second seating units when in the interconnected condition to separate the first and second seating units. This configuration can enable the rapid interconnection and separation of adjacent seating units.

23 Claims, 5 Drawing Sheets

CONNECTOR FOR ADJACENT SEATING UNITS

FIELD OF THE INVENTION

The present invention relates generally to furniture, and more particularly to connecting adjacent furniture pieces.

BACKGROUND OF THE INVENTION

Many homes have multiple seating units, such as chairs and sofas, residing and arranged in a living room or den. With the trend toward increased use of the living room or den as a recreational, entertainment and dining space, many consumers desire furniture pieces that provide function and/or flexibility beyond the conventional seating and support provided by conventional furniture. As an example of furniture having added flexibility, many manufacturers offer "sectional" sofas, which enable the user to place multiple sections of a sofa (typically lacking one or both arms) side-by-side to create multiple seating locations. The consumer may purchase different numbers of sections in order to create a desired sofa configuration, and the sections can be rearranged by the seller or the consumer to create more sofa configurations. Sectional sofas may have generally aligned seating locations or may include one or more corner sections that provide an L-shaped or U-shaped sofa.

Some consumers may desire that the sections of a sectional sofa include additional features. For example, so-called "reclining" sectional pieces move from an upright position to one or more reclined positions that are particularly suitable for sleeping, reading, and watching television. Often an extendable ottoman or footrest is included in a reclining sectional piece. Reclining sectional pieces typically have upholstered box-type frames within which reclining mechanisms are mounted; often the reclining mechanisms are supported by a base that rests on the underlying floor or have their own integrated base. Exemplary reclining sectional pieces are illustrated in U.S. Pat. No. 4,740,031 to Rogers, Jr. and U.S. Pat. No. 5,064,244 to Sproule, the contents of each of which are hereby incorporated herein in their entireties.

One of the difficulties with sectional pieces is maintaining the relative positions of the pieces once they are placed by the user. Many reclining seating units include a driving handle or a release mechanism mounted on the outer surface of the arm to move the seating unit from an upright position to a reclined position. Clearly, if such a reclining unit is to be used in a sectional sofa, either it must serve as the end section or it must be actuated in another manner (for example, U.S. Pat. No. 5,064,244 to Sproule, supra, includes a console between two reclining sections, wherein the console includes actuating buttons for the reclining sections). Clearly, either of these attachment techniques limits the flexibility of the reclining sections.

One additional method of attaching adjacent sectional pieces is to simply fasten them together with a horizontal rod or the like on one sectional piece that is inserted through a sleeve mounted on the adjacent sectional piece. However, such attachment can make it difficult and/or inconvenient to attach the sections in the event the user wishes to separate them (for example, to rearrange the room). Also, this technique may negative impact the appearance of the upholstery of the sections. Further, this technique is unsuitable if the arms and/or frame of the seating unit move relative to the floor when the seating unit reclines.

SUMMARY OF THE INVENTION

The present invention can provide a structure and technique for interconnecting adjacent furniture pieces that facilitates attachment and detachment of such pieces. As a first aspect, the present invention is directed to a furniture assembly, comprising: a first seating unit with a stationary support; a second seating unit with a stationary support; and a connector that is configured to interconnect the first and second seating units such that respective lateral portions thereof are adjacent. The connector includes: a first component attached to the stationary support of the first seating unit; a second component attached to the stationary support of the second seating unit; and interconnecting structure attached to the first and second components that (a) prevents relative horizontal movement of the first and second seating units when the first and second seating units are in an interconnected condition, and (b) permits relative vertical movement of the first and second seating units when in the interconnected condition to separate the first and second seating units. This configuration can enable the rapid interconnection and separation of adjacent seating units.

In some embodiments, the interconnecting structure is further configured such that it permits interconnection of the first and second seating units via relative horizontal movement of the first and second seating units as the first and second seating units are brought together from a separated condition. In other and additional embodiments, the interconnecting structure is configured to permit interconnection of the first and second seating units via relative transverse horizontal movement.

As a second aspect, the present invention is directed to a furniture assembly as defined above, wherein first and second reclining seating sections are interconnected via a connector as described above, with the connector components being mounted to reclining mechanisms of the reclining seating units. In particular, the first and second components of the connector may be mounted to the bases of the reclining mechanisms.

As a third aspect, the present invention is directed to a connector for interconnecting two objects in adjacent relationship comprising a first component and a second component. The first component is adapted to be mounted on one of the two objects and comprises a base plate and an upright post mounted on the base plate. The second component is adapted to be mounted on a second of the two objects and comprises a base plate having a slot configured to receive the post and a locking finger rotatably mounted to the base plate. The locking finger is rotatable between a receiving position, in which the locking finger does not overlie the slot, such that the post is free to enter the slot, and an engagement position, in which the locking finger at least partially overlies the slot and engages the post, such that the post is prevented from exiting the slot. The locking finger and post are configured such that the first component can be separated from the second component by relative movement thereof in a direction substantially parallel with the post.

DETAILED DESCRIPTION OF EMBODIMENTS OF THE INVENTION

Figure 1:
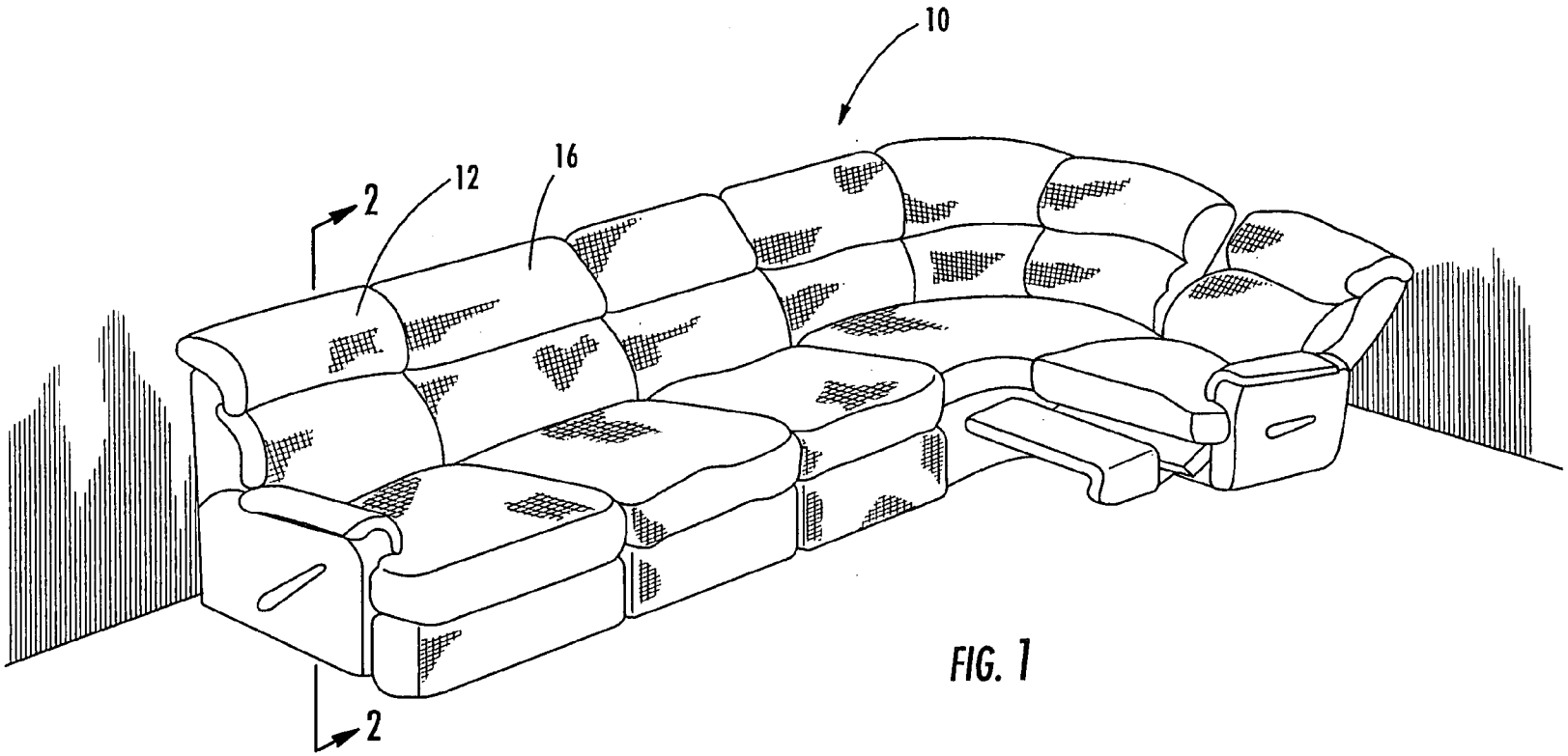
FIG. 1 is a perspective view of a sectional sofa according to the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

The present invention is directed to reclining seating units, each of which has a stationary base, a seat, and a backrest. As used herein, the terms "forward", "front" and derivatives thereof refer to the direction defined by a vector extending from the backrest toward the seat parallel to the underlying surface. Conversely, the terms "rearward" and derivatives thereof refer to the direction directly opposite the forward direction; i.e., the rearward direction is defined by a vector that extends from the seat toward the backrest parallel to the underlying surface. The forward and rearward directions together comprise the "longitudinal" directions relative to the seating unit. For an individual reclining sectional piece, the term "outward" and derivatives thereof refer to the direction defined by a vector originating in the center of a sectional piece and extending in the plane of the underlying surface and perpendicular to the forward and rearward directions. The terms "inboard", "inward" and derivatives thereof refer to the direction directly opposite to the lateral direction as defined hereinabove. The outward and inward directions together comprise the "lateral" or "transverse" directions relative to the sectional piece.

Figure 2:
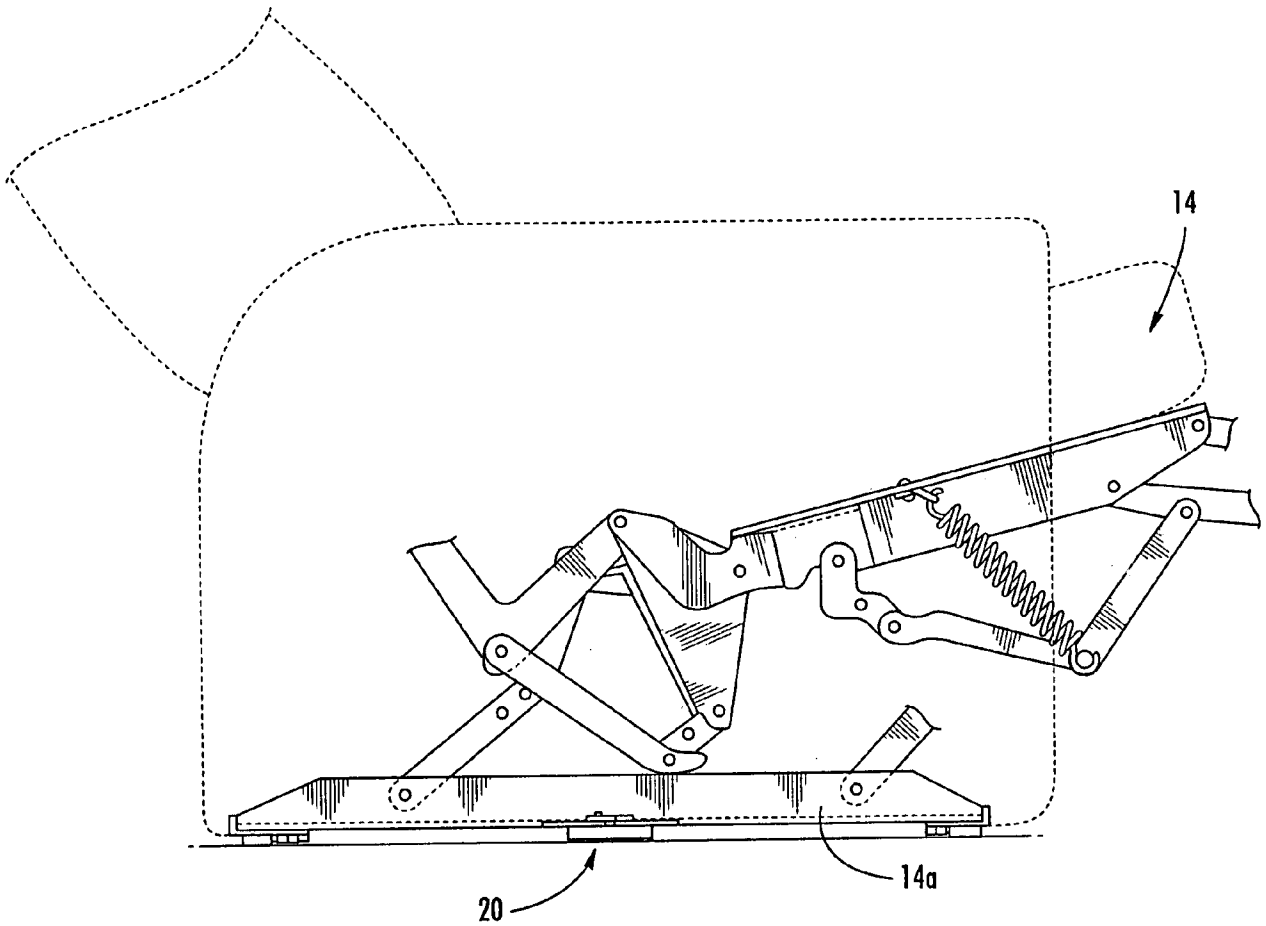
FIG. 2 is a side view of an exemplary reclining mechanism of a sectional sofa showing attachment of a connector of the present invention.
Figure 3:
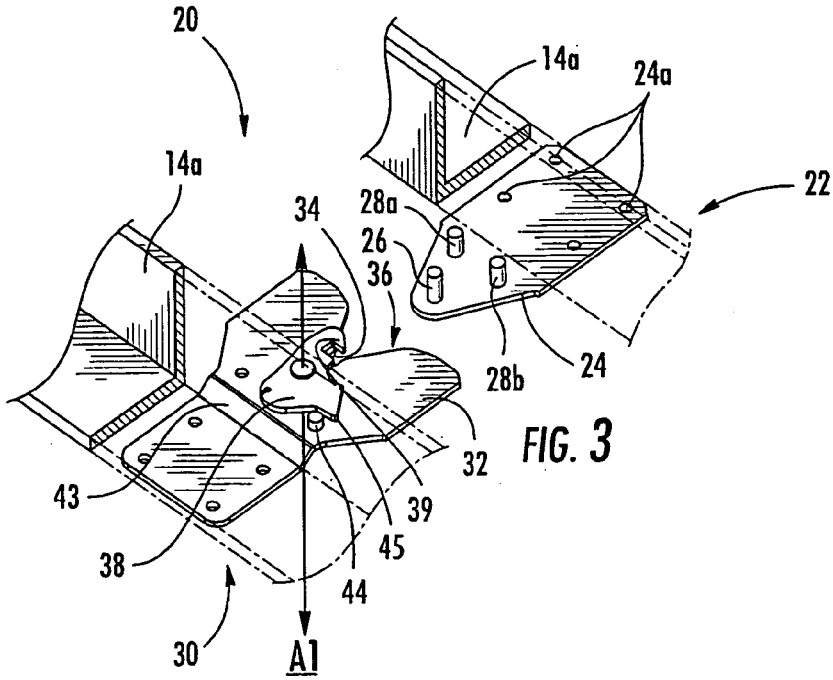
FIG. 3 is an enlarged perspective view of the connector of FIG. 2 with the male and female components thereof (and, in turn, the reclining sectional units to which they are mounted) in a separated condition, and with the locking figure of the female component in an engagement position.

Referring now to the figures, a portion of a sectional sofa, designated broadly at 10, is illustrated in FIG. 1. The sectional sofa 10 includes two reclining sections 12, 16, each of which has an underlying base, a seat, a backrest and an extendable ottoman. The base, seat, backrest and ottoman are mounted to one another via a respective pair of reclining mechanisms 14 (one is shown in FIG. 2), which control the relative movement of the seat, backrest and ottoman of each reclining section 12, 16.

In the illustrated embodiment, each of the reclining sections rests on the underlying surface via a base 14*a*; however, those skilled in this art will recognize that reclining mechanism, and wall proximity and non-wall-proximity reclining mechanisms) may also be suitable for use with the present invention. The reclining mechanisms 14 may be actuated in any manner known to be suitable for such actuation; examples include release cords and cables, push buttons, handles, and even simple application of force to the backrest of the reclining sections 12, 16.

Referring now to FIGS. 3–6, the reclining sections 12, 16 are interconnected with a connector 20. The connector 20 includes a male component 22 and a female component 30 that engage one another to interconnect the reclining sections 12, 16. Each of the components is discussed in greater detail below.

Referring still to FIGS. 3–6, the male component 22, which is typically formed of steel, includes as a base a thin base plate 24 (typically formed of steel) that is tapered at one end. At the non-tapered end, the base plate 24 is fixed to one of the reclining mechanisms 14 of the reclining section 12 (in this instance, to the base 14*a* via bolts inserted through apertures 14*a*) and extends laterally therefrom such that a portion of the base plate 24 is exposed from the footprint of the reclining section 12. Near the vertex of the tapered end of the base plate 24, an upwardly-extending post 26 is mounted to the base plate 24; typically the post 26 rises between about 0.25 and 1.0 inches above the upper surface of the base plane 24. In the illustrated embodiment two posts 28*a*,28*b* are mounted on the base plate 24 between the reclining mechanism and the post 26. The posts 28*a*, 28*b* serve as stops that limit the relative motion of the male and female components 22, 30; alternatively, the posts 28*a*, 28*b* may be replaced with a raised step that extends across some or all of the expanse of the base plate 24, or may be omitted entirely.

Referring again to FIGS. 3–6, the female component 30, which is also typically formed of steel, includes a generally Y-shape base plate 32 that serves as its base. At one end, the base plate 32 is fixed to the base 14*a* of one of the reclining mechanisms 14 of the reclining section 16 and extends laterally therefrom such that a portion thereof is slightly exposed from the footprint of the reclining section 16. A slot 34 is located at the exposed end of the base plate 32. The slot 34 has an optional flared entry portion 36 that facilitates entry therein.

A locking finger 38 having a claw portion 39 is rotatably mounted on the base plate 30. The locking finger 38 is rotatable about an axis A1 between a receiving position (FIG. 4), in which entry to the closed end of the slot 34 from the open end can occur, and an engagement position (FIGS. 3, 5 and 6), in which part of the claw portion 39 covers a portion of the slot 34 and the angled surface 42 of the claw portion 39 faces toward the open end of the slot 34 and the claw portion 39 can engage an object within the slot 34. A spring 40 or other biasing unit is mounted to the base plate 32 below the locking finger 38 and biases the locking finger 38 toward the engagement position. A step 43 is located on the base plate 32 between the locking finger 38 and the fixed end of the base plate 32 such that the lower surface of the locking finger 38 is above the upper surface of the mounted end of the base plate 32. A stop post 44 is mounted to the base plate 32 near the step 43 such that rotation of the locking finger 38 about the axis A1 toward the engagement position ceases when a contact surface 45 of the locking finger 38 contacts the stop post 44.

Figure 4:
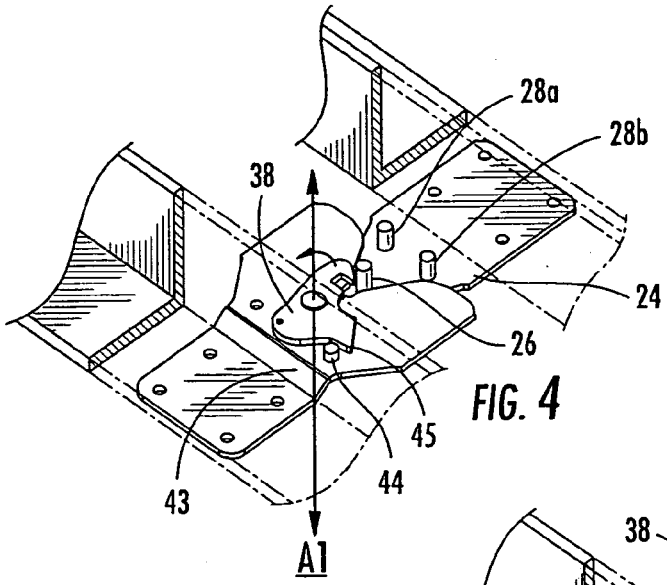
FIG. 4 is an enlarged perspective view of the connector of FIG. 2 with the locking finger moving to the receiving position as the male and female components are brought together.
Figure 5:
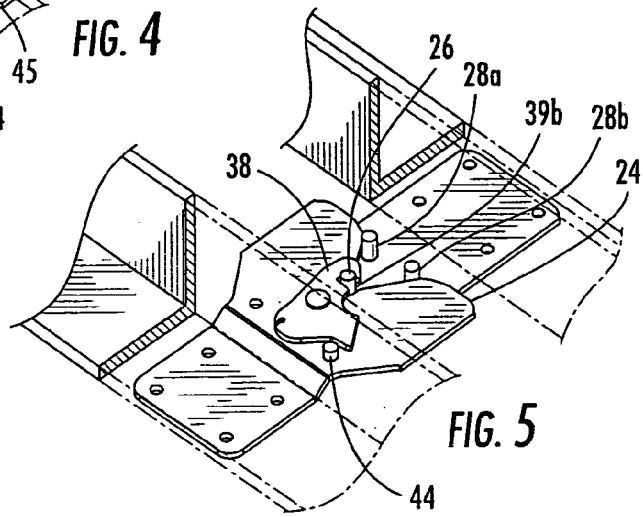
FIG. 5 is an enlarged perspective view of the connector of FIG. 2 with the locking finger in its engagement position engaging the post of the male component, such that the reclining sectional units mounted to the male and female components of the connector are in an interconnected condition.
Figure 6:
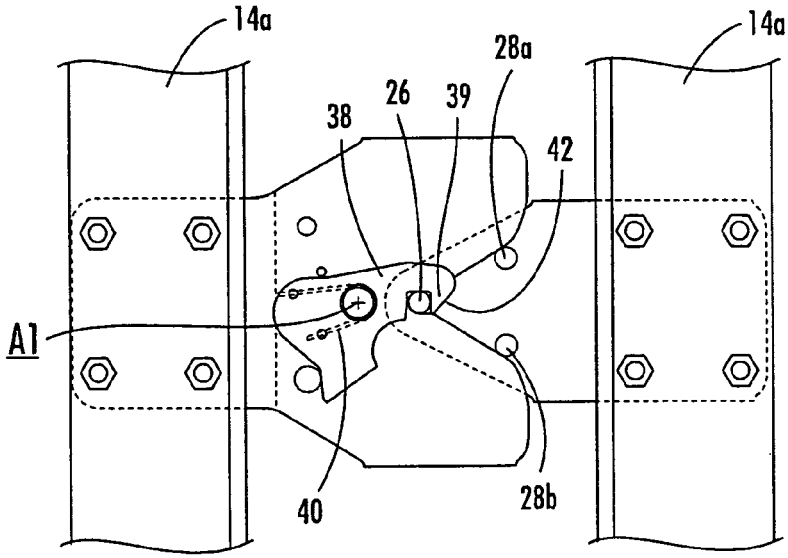
FIG. 6 is an enlarged top view of the connector of FIG. 2 in an engaged condition.

To interconnect the reclining sections 12, 16 when they are in a separated condition (FIG. 3), the reclining sections 12, 16 are positioned in side-by-side relationship, with the male component 22 extending toward the female component 30. The reclining sections 12, 16 can be slid in the transverse direction toward one another such that the post 26 of the male component 22 enters the open end of the slot 34 of the female component 30. Entry of the post 26 into the slot 34 is facilitated by the flared entry portion 36 of the slot 34. The post 26 strikes the angled surface 42 of the locking finger 38 as the locking finger 38 is in the engagement position; interaction between the post 26 and the contact surface 45 causes the claw portion 39 of the locking finger 38 to rotate away from the slot 34 to the receiving position (FIG. 4). Once the claw portion 39 no longer overlies the slot 34, the post 26 is free to slide within the slot 34 to the closed end thereof. After the post 26 clears the tip 39*b* of the claw portion 39, the locking finger 38, biased by the spring 40, returns to its original engagement position, thereby engaging the post 26 and locking it in place (FIG. 5). Relative horizontal movement of the male and female components 22, 30 (and, consequently, relative horizontal movement of the reclining sections 12, 16) is prevented by the post 26 and locking finger 38. Also, contact between the lateral edges of the female component 30 and the posts 28*a*, 28*b* halts movement of the reclining sections 12, 16 toward each other.

Figure 7A:
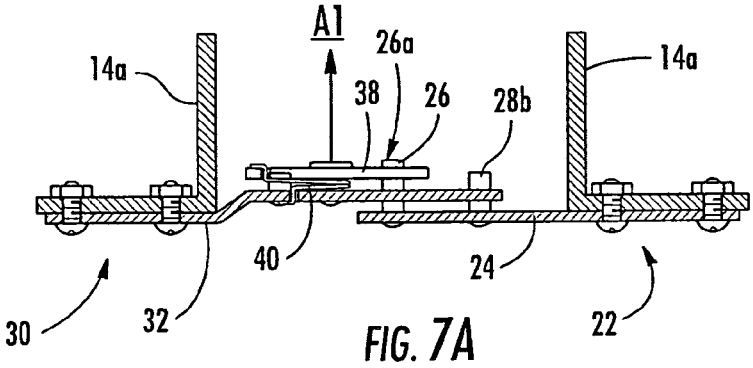
FIG. 7A is a front view of the connector of FIG. 2 in an engaged condition.
Figure 7B:
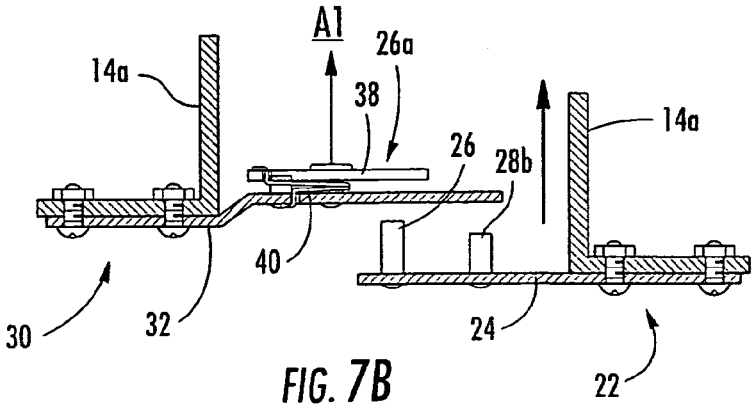
FIG. 7B is a front view of the connector of FIG. 7A showing how the male and female components can be detached.

The reclining sections 12, 16 can be separated from the interconnected condition by lifting the reclining section 16 that is attached to the female component 30 slightly upwardly (FIGS. 7A and 7B). The engagement of the post 26, slot 34 and locking finger 38 permits such relative vertical movement. The ascent of the female component 30 causes the base plate 32 to rise above the top end 26*a* of the post 26, at which point the female component 30 is completely disengaged from the male component 22. As such, the reclining sections 12, 16 are detached from one another.

Figure 8:
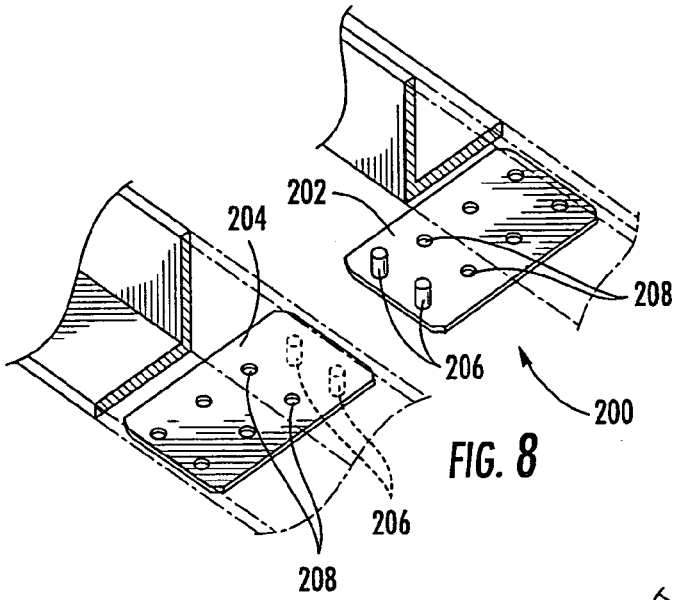
FIG. 8 is an enlarged top view of an alternative embodiment of a connector of the present invention shown in a separated condition.
Figure 9:
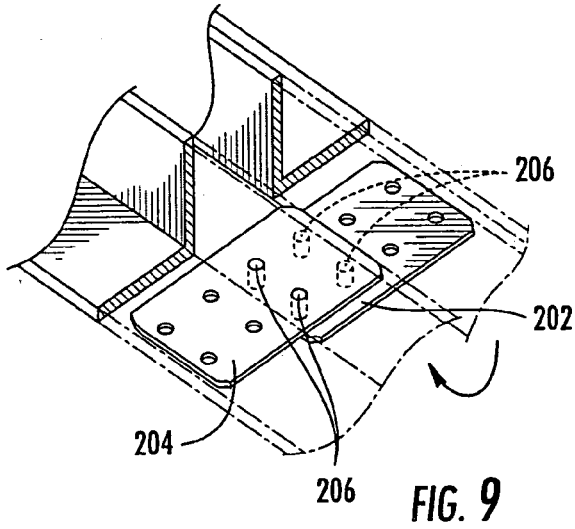
FIG. 9 is an enlarged top view of the connector of FIG. 8 as it interconnects two reclining sections.
Figure 10:
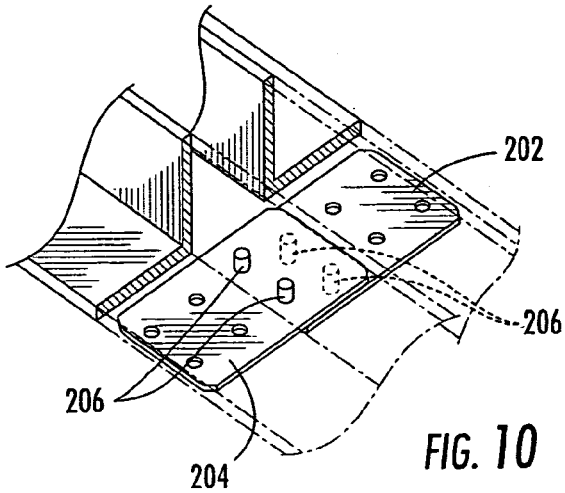
FIG. 10 is an enlarged top view of the connector of FIG. 8 in an interconnected condition.

Those skilled in this art will recognize that other interconnecting structure of the male and female components may also be suitable for use with the present invention. As one example, the slot 34 on the female component 30 may extend longitudinally (ie., forwardly or rearwardly) with the post on the male member 22 entering the slot 34 longitudinally. As another example, and referring to FIGS. 8–10, the components comprising a connector 200 may not be "male" and "female", but instead may comprise plates 202, 204 that can be mounted to the reclining mechanisms or other support structure of the seating units. The plates 202, 204 have mating posts 206 and apertures 208, wherein the posts 206 of one plate 202 are received in the apertures 208 of the other plate 204. With this configuration, attachment of the reclining sections can be achieved by raising one side of a reclining section slightly higher than that of an adjacent reclining section and moving the downwardly-extending posts 206 of the raised reclining section over the apertures 208 of the non-raised reclining section. Once the posts 206 of each reclining section are inserted into the apertures 206 of the other reclining section, the reclining sections are prevented from relative horizontal movement, but are free to be disengaged by relative vertical movement.

Those skilled in this art will recognize that the present invention may include non-reclining sections as well as reclining sections of a section sofa, entirely non-reclining sections, and other seating units that are not typically used in a sectional sofa. The male and female components of the connector should be mounted to a stationary support within the sections to be interconnected, which can be a portion of a reclining mechanism as described above, a portion of the frame, or some other structure that is stationary relative to the floor when the seating unit is in use.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

That which is claimed is:

1. A furniture assembly, comprising:

a first seating unit with a stationary support;

a second seating unit with a stationary support;

a connector that is configured to interconnect the first and second seating units such that respective lateral portions thereof are adjacent, the connector including:

a first component attached to the stationary support of the first seating unit;

a second component attached to the stationary support of the second seating unit; and interconnecting structure attached to the first and second components that (a) prevents relative horizontal movement of the first and second seating units when the first and second seating units are in an interconnected condition, and (b) permits relative vertical movement of the first and second seating units when in the interconnected condition to separate the first and second seating units;

wherein the interconnecting structure is further configured such that it permits interconnection of the first and second seating units via relative horizontal movement of the first and second seating units as the first and second seating units are brought together from a separated condition and such that said relative horizontal movement locks the first and second seating units together.

2. The furniture assembly defined in claim 1, wherein the interconnecting structure is configured to permit interconnection of the first and second seating units via relative transverse horizontal movement.

3. The furniture assembly defined in claim 1, wherein the first component includes a base, and wherein the interconnecting structure includes an upright post attached to the base.

4. The furniture assembly defined in claim 3, wherein the first component includes a stop that ceases relative transverse horizontal movement of the first and second seating units during interconnection.

5. The furniture assembly defined in claim 3, wherein the second connector component includes a base, and wherein the interconnecting structure comprises a slot in the base that is configured to receive the post attached to the first component.

6. The furniture assembly defined in claim 5, wherein the slot includes a flared entry portion.

7. The furniture assembly defined in claim 5, wherein the interconnecting structure comprises a locking finger rotatably mounted on the second component base, the locking finger being rotatable between a receiving position and an engagement position, in which the locking finger engages the post as the first and second seating units are in the interconnected condition.

8. The furniture assembly defined in claim 7, wherein the interconnecting structure further comprises a biasing unit attached to the second component that biases the locking finger toward the engagement position.

9. The furniture assembly defined in claim 8, wherein the biasing unit comprises a spring.

10. A connector for interconnecting two objects in adjacent relationship, comprising:

a first component adapted to be mounted on one of the two objects, the first component comprising:

a generally horizontal base plate; and an upright post mounted on and normal to the base plate; and a second component adapted to be mounted on a second of the two objects, the second component comprising:

a generally horizontal base plate having a slot configured to receive the post; and a locking finger rotatably mounted to the base plate, the locking finger being rotatable about an axis normal to the base plate between a receiving position, in which the locking finger does not overlie the slot, such that the post is free to enter the slot, and an engagement position, in which the locking finger at least partially overlies the slot and engages the post, such that the post is prevented from exiting the slot;

the locking finger and post being configured such that the first component can be separated from the second component by relative movement thereof in a direction substantially parallel with the post.

11. The connector defined in claim 10, wherein the second component further comprises a biasing unit that biases the locking finger toward the engagement position.

12. The connector defined in claim 11, wherein the biasing unit comprises a spring.

13. The connector defined in claim 10, wherein the slot includes a flared entry portion.

14. The connector defined in claim 10, wherein the first component includes a stop that prevents movement of the post within the slot.

15. A furniture assembly, comprising:

a first reclining seating section with a reclining mechanism;

a second reclining seating section with a reclining mechanism;

a connector that is configured to interconnect the first and second reclining seating sections such that respective lateral portions thereof are adjacent, the connector including:

a first component attached to the reclining mechanism of the first seating unit;

a second component attached to the reclining mechanism of the second seating unit; and interconnecting structure attached to the first and second components that (a) prevents relative horizontal movement of the first and second seating units when the first and second seating units are in an interconnected condition, and (b) permits relative vertical movement of the first and second seating units when in the interconnected condition to separate the first and second seating units;

wherein the interconnecting structure is further configured such that it permits interconnection of the first and second seating units via relative horizontal movement of the first and second seating units as the first and second seating units are brought together from a separated condition and such that said relative horizontal movement locks the first and second seating units together.

16. The furniture assembly defined in claim 15, wherein the first component is mounted to the base of the reclining mechanism of the first reclining seating section, and the second component is mounted to the base of the reclining mechanism of the second reclining seating section.

17. The furniture assembly defined in claim 16, wherein the first component includes a base, and wherein the interconnecting structure includes an upright post attached to the base.

18. The furniture assembly defined in claim 17, wherein the first component includes a stop that ceases relative transverse horizontal movement of the first and second seating units during interconnection.

19. The furniture assembly defined in claim 17, wherein the second connector component includes a base, and wherein the interconnecting structure comprises a slot in the base that is configured to receive the post attached to the first component.

20. The furniture assembly defined in claim 19, wherein the slot includes a flared entry portion.

21. The furniture assembly defined in claim 19, wherein the interconnecting structure comprises a locking finger rotatably mounted on the second component base, the locking finger being rotatable between a receiving position and an engagement position, in which the locking finger engages the post as the first and second reclining seating sections are in the interconnected condition.

22. The furniture assembly defined in claim 21, wherein the interconnecting structure further comprises a biasing unit attached to the second component that biases the locking finger toward the engagement position.

23. The furniture assembly defined in claim 22, wherein the biasing unit comprises a spring.

* * * * *